US007354025B2

(12) United States Patent
Searle

(10) Patent No.: US 7,354,025 B2
(45) Date of Patent: Apr. 8, 2008

(54) ROOF SCAFFOLD BRACKET

(75) Inventor: Peter Searle, Wandana Heights (AU)

(73) Assignee: Brunsen Pty. Ltd., Greelong, Victoria (AU)

( * ) Notice: Subject to any disclaimer, the term of this patent is extended or adjusted under 35 U.S.C. 154(b) by 0 days.

(21) Appl. No.: 10/469,773

(22) PCT Filed: Mar. 1, 2002

(86) PCT No.: PCT/AU02/00229

§ 371 (c)(1),
(2), (4) Date: Sep. 4, 2003

(87) PCT Pub. No.: WO02/070835

PCT Pub. Date: Sep. 12, 2002

(65) Prior Publication Data

US 2004/0129847 A1 Jul. 8, 2004

(30) Foreign Application Priority Data

Mar. 5, 2001 (AU) ..... PR3527

(51) Int. Cl.
*A47G 29/02* (2006.01)
*E04G 3/26* (2006.01)

(52) U.S. Cl. ..... 248/237; 182/45; 248/235

(58) Field of Classification Search ..... 248/237, 248/238, 236, 235; 182/45, 82, 150, 126.1, 182/206; 52/126.1, 749.12
See application file for complete search history.

(56) References Cited

U.S. PATENT DOCUMENTS

| | | | | |
|---|---|---|---|---|
| 909,012 | A * | 1/1909 | McCarty | 248/237 |
| 1,133,878 | A * | 3/1915 | Nagel | 248/237 |
| 2,888,225 | A * | 5/1959 | McQuin | 248/237 |
| 3,901,481 | A | 8/1975 | Probst | |
| 4,666,131 | A | 5/1987 | Kettelkamp | |
| 4,676,341 | A * | 6/1987 | Shaffstall | 182/45 |
| 4,826,122 | A | 5/1989 | Cupp | |
| 4,856,745 | A | 8/1989 | Mabie | |
| 5,113,971 | A | 5/1992 | Violet | |
| 5,318,148 | A | 6/1994 | Franco et al. | |
| 5,558,312 | A | 9/1996 | Brennan | |
| 5,624,006 | A | 4/1997 | Richardson | |
| 5,988,578 | A | 11/1999 | Davies | |
| 2004/0129847 | A1 * | 7/2004 | Searle | 248/237 |

FOREIGN PATENT DOCUMENTS

| | | |
|---|---|---|
| AU | 12216/95 | 8/1995 |
| CA | 2325839 A | 5/2002 |
| DE | 2637298 A | 2/1978 |

(Continued)

*Primary Examiner*—Carl D. Friedman
*Assistant Examiner*—Tan Le
(74) *Attorney, Agent, or Firm*—Haynes and Boone, LLP

(57) ABSTRACT

The present invention provides a roof scaffold bracket (12) having a roof fixing arm (14), a platform support arm (16) pivotally attached (28) at one end of roof fixing arm (14) and an adjustment arm (18) pivotally attached (20) at the other end of roof fixing arm (14). Platform support arm (16) is adapted to be connected to adjustment arm (18). At least one foot means (72) is provided on roof fixing arm (14) whereby the at least one foot means (72) is adapted to secure the roof scaffold bracket (12) to a frame element (81) of a roof (42).

10 Claims, 5 Drawing Sheets

FOREIGN PATENT DOCUMENTS

| | | | | |
|---|---|---|---|---|
| DE | 3117584 | A | | 12/1982 |
| DE | 3319658 | A | | 12/1984 |
| DE | 4034229 | A1 | | 4/1992 |
| EP | 0318373 | | * | 11/1987 |
| FR | 2566820 | A | | 1/1986 |
| GB | 2201716 | A | | 9/1988 |
| WO | WO89/04411 | | * | 5/1989 |
| WO | WO 98 26141 | A | | 6/1998 |
| WO | WO 02/070835 | | * | 9/2002 |

* cited by examiner

ROOF SCAFFOLD BRACKET

CROSS REFERENCE

This application is a national phase filing of international application No. PCT/AU02/00229, filed Mar. 1, 2002, which claims priority to Australia patent application No. PR 3527, filed Mar. 5, 2001.

This invention relates to a roof scaffold bracket and relates particularly, though not exclusively, to a roof scaffold bracket for providing a roof scaffold support which allows safe work practices on any pitch of roof.

Roof scaffolding systems for allowing work to be undertaken on rooves have in the past been expensive and time consuming to erect. The scaffolding must be mounted on the ground and a cantilever arrangement connected to that scaffolding hangs over the roof. Devices requiring no scaffolding support on the ground are illustrated in U.S. Pat. Nos. 5,113,971; 5,318,148; 5,988,578; and 4,856,745. All of these devices are fairly complicated constructions which are heavy and difficult to erect. They have limited flexibility as they can only be used on a particular type of roof construction. They are not flexible to used on a tiled roof, corrugated iron roof or no roof.

It is an object of the present invention to provide a roof scaffold bracket that is compact and quick and easy to erect and dismantle.

A further object of the invention is to provide a roof scaffold bracket that can be used on any type of roof.

With these objects in view the present invention provides a roof scaffold bracket including a roof fixing arm, a platform support arm pivotally attached at one end of said roof fixing arm and an adjustment arm pivotally attached at the other end of said roof fixing arm, said platform support arm adapted to be connected to said adjustment arm, at least one foot means provided on said roof fixing arm and at least said one foot means adapted to secure said roof scaffold bracket to a frame element of a roof.

Preferably said roof scaffold bracket includes a handrail support arm attachable to said adjustment arm. In a preferred aspect of the invention at least two feet means are provided at each end of said roof fixing arm.

Preferably each foot means includes a pair of spaced apart parallel members which are adapted to lie in respective valleys of a corrugated roofing material.

In one embodiment a foot support plate is adapted to engage with respective feet means and is adapted to be secured to a roof batten in the form of a roof tile. Preferably said foot support plate includes a lip at one end for abutment with said roof batten and a pair of tabs at or adjacent the other end for abutment with said foot means. Preferably said tabs include apertures for passage therethrough of said spaced apart parallel members.

In a further embodiment a foot support is adapted to engage with respective feet means and is adapted to be secured to a roof rafter. Said foot support having an L-shaped bracket which include apertures for passage therethrough of said spaced apart parallel members. A further L-shaped bracket is attached to said L-shaped bracket by a joining member and said further L-shaped bracket is adapted to be attached to said roof rafter.

In order that the invention may be more readily understood and put into practical effect, reference will now be made to the accompanying drawings, wherein like reference numerals refer to like elements and in which.

Figure 1:
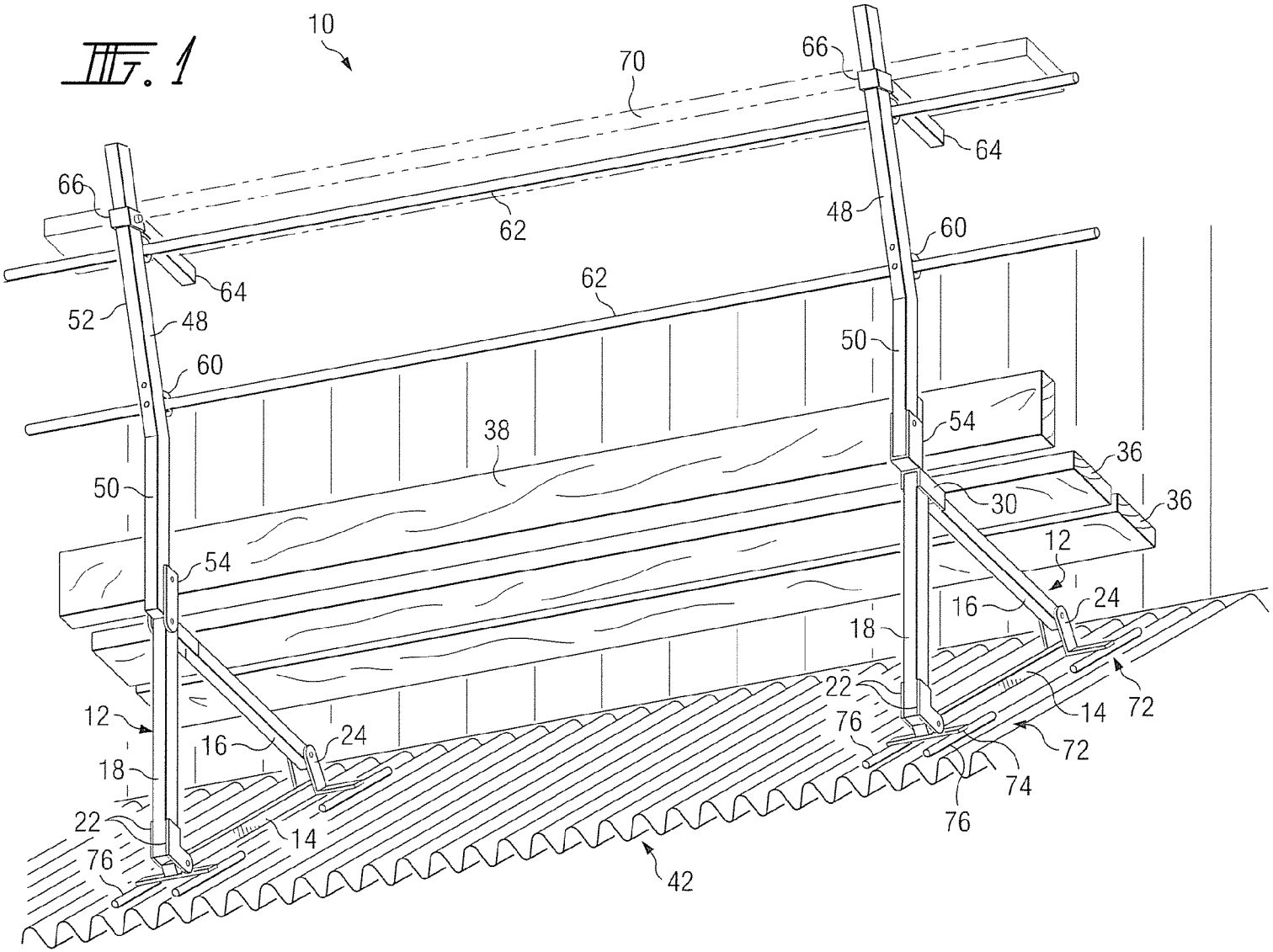
FIG. 1 is a perspective view of a first embodiment of a roof scaffold support using the roof scaffold bracket of the invention installed on a roof.
Figure 8:
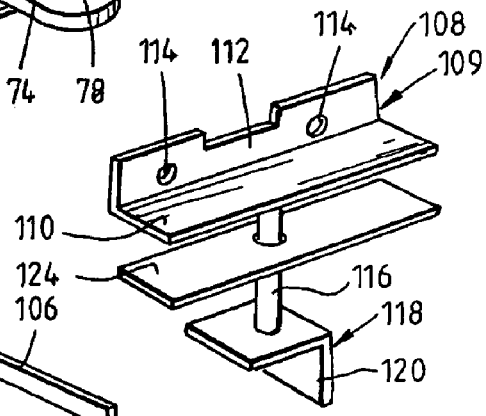
FIG. 8 is a second foot support plate for allowing the roof scaffold bracket of FIG. 1 to be used on a tiled roof.
Figure 10:
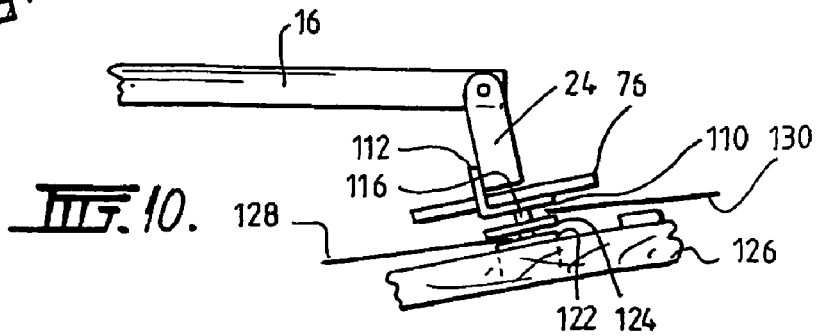
Figure 11:
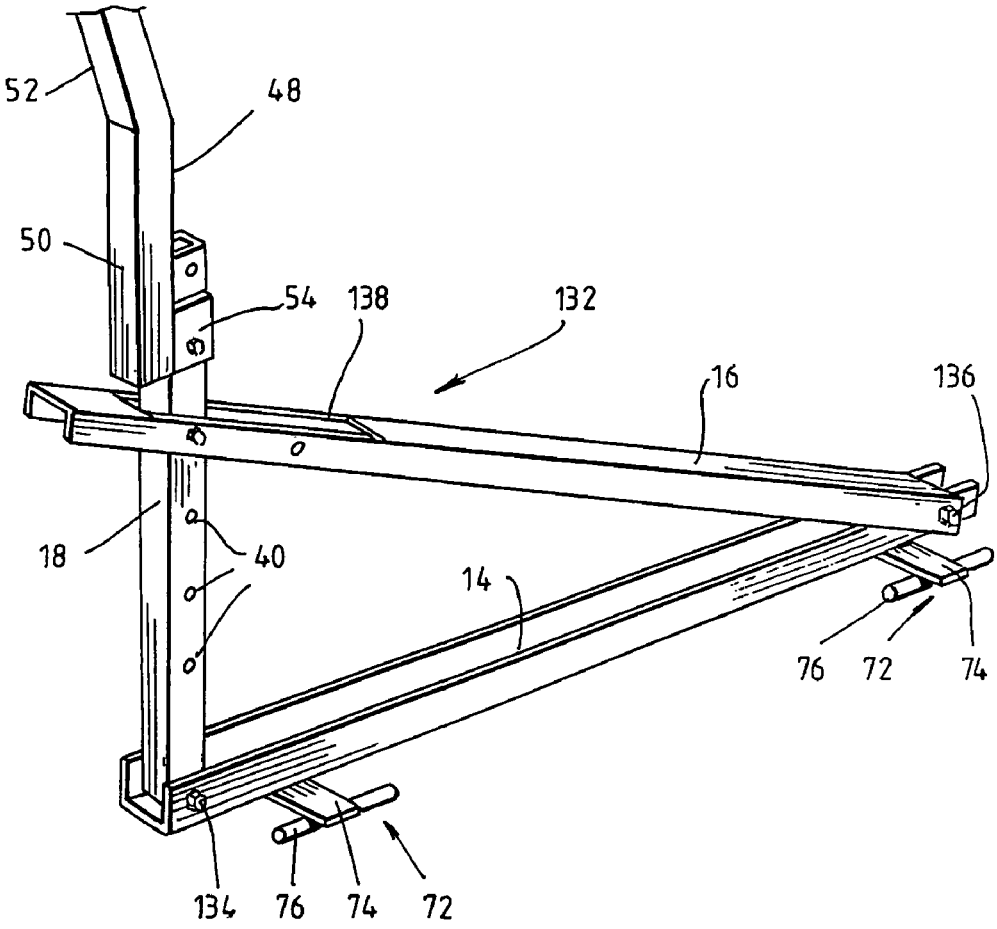

FIG. 10 is a side view of the roof scaffold bracket of FIG. 1 in combination with the second foot support plate shown in FIG. 8; and FIG. 11 is a perspective view of a second embodiment of a roof scaffold bracket In the drawings there is shown a roof scaffold support 10 which includes two or more roof scaffold brackets 12. The scaffold brackets are typically formed from metallic sections with steel and aluminium being preferred materials. Each roof scaffold bracket 12 has a roof fixing arm 14, a platform support arm 16 and an adjustment arm 18. Roof fixing arm 14 is typically formed from square hollow tubular steel or U-shaped channel section and has a pivot hole 20 at one end to cooperate with corresponding pivot holes in right angular tabs 22 on either side of the end of adjustment arm 18. A bolt (not shown) can be placed through the aligned pivot holes to provide a pivoting movement between roof fixing arm 14 and adjustment arm 18. At the other end of roof fixing arm 14 is a pair of tabs 24 having aligned pivot holes 26 which cooperate with pivot holes (not shown) of platform support arm 16. A bolt 28 (FIG. 2) will allow a pivoting movement between roof fixing arm 14 and platform support arm 16.

Figure 2:
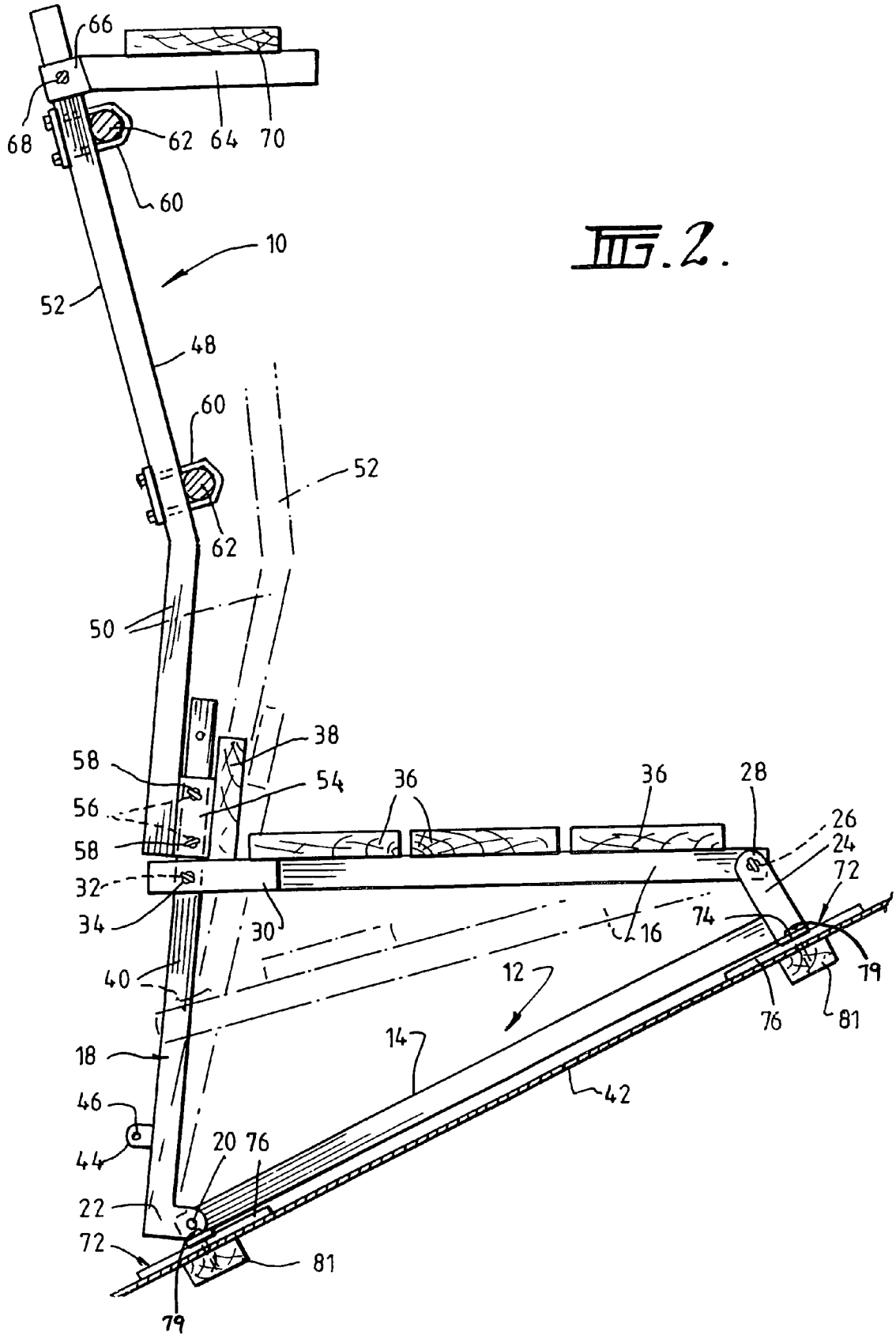
FIG. 2 is a side cross-section view of the roof scaffold support shown in FIG. 1.
Figure 3:
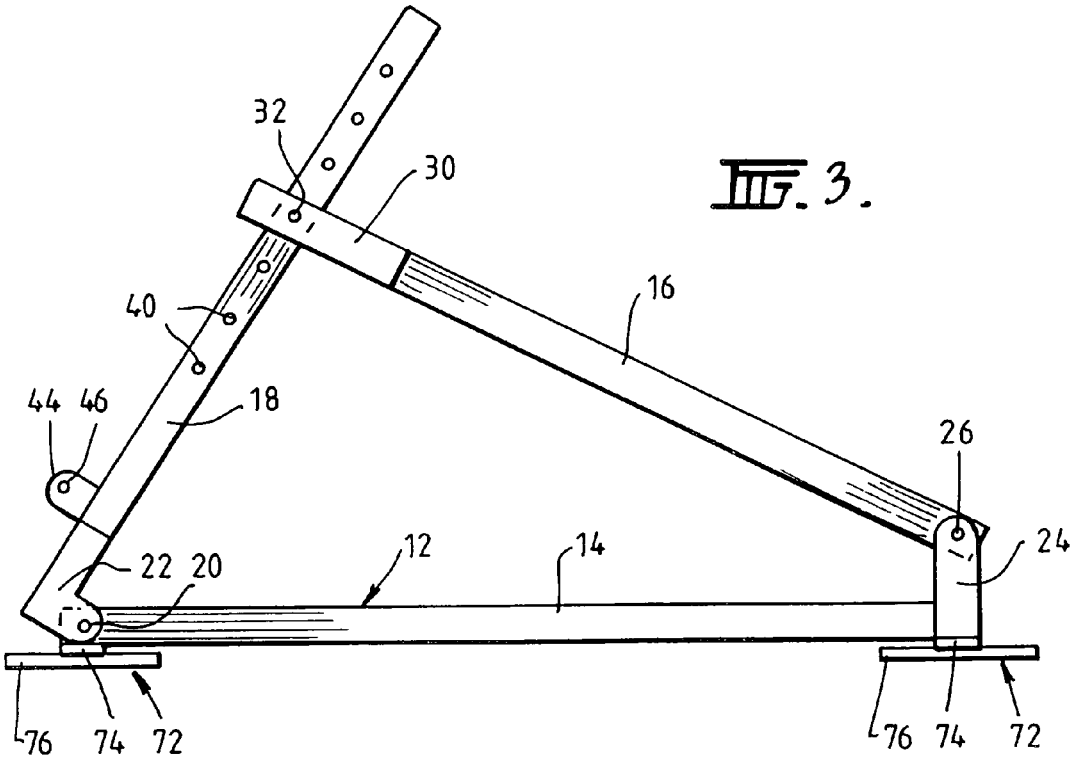
FIG. 3 is a side view of the roof scaffold bracket shown in FIG. 1 in the assembled position.

Platform support arm 16 is typically formed from square hollow tubular steel or U-shaped channel section and includes a pair of extensions 30 welded to either side of platform support arm 14 adjacent the free end thereof. The extensions 30 have aligned holes 32 for reception of a bolt 34 (FIG. 2). In use, platform support arm 14 will support a plurality of planks 36 which provide a walkway for workmen and a kickboard 38.

Adjustment arm 18 is typically formed from square hollow tubular steel or U-shaped channel section and includes a plurality of adjustment holes 40. Holes 40 can be aligned with holes 32 of platform support arm to allow bolt 34 to lock platform support arm 32 in a substantially horizontal position no matter what pitch of roof 42 is encountered. A tab or tabs 44 may also be provided which includes hole(s) 46 which when roof scaffold bracket 12 is in the collapsed position shown in FIG. 4 can be locked in that position by a bolt (not shown).

A handrail support arm 48 can also be provided to reduce the risk of a workmen falling from roof 42. Again the handrail support arm 48 is typically formed from square hollow tubular steel and preferably includes a vertical section 50 and an angled section 52. Angled section 52 will allow more working space for the workmen to undertake their tasks. Vertical section 50 has a sleeve 54 welded at its free end which, in use, will slide over the end of adjustment arm 18. Holes 56 cooperate with holes 40 of adjustment arm 18 to allow sleeve 54 to be fastened to adjustment arm 18 by bolts 58. U-clamps 60 hold rails 62 to angled section 52 to form safety rails to assist in preventing workmen falling off roof 42. The nature of the clamping action, the number of or positioning of rails 62 can vary to suit the working environment e.g. a rail could also be placed across adjustment arm 18. If required, a further support bracket 64 can be slid over angled section 52 using sleeve 66 attached to one end of further support bracket 64. A bolt 68 can lock sleeve to angled section 52. A further plank 70 rests on further support brackets 64 to provide a table for tools, paint and other equipment that the workmen may require.

To complete roof scaffold bracket 12, feet 72 are provided at each end of roof fixing arm 14. Each foot 72 comprises a laterally oriented tab 74 welded to the underneath of roof fixing arm 14. A pair of tubes 76 are welded to the underneath of tab 74 and are arranged parallel to roof fixing arm 14. The spacing between the tubes 76 is selected to correspond to the spacing between a predetermined number of valleys in a sheet of corrugated roofing iron. In use, the tubes 76 will lie in valleys of corrugated iron to prevent transverse movement of roof scaffold bracket 12. A pair of holes 78 are provided in tab 74 for securing each foot 72 to a batten or rafter.

Figure 4:
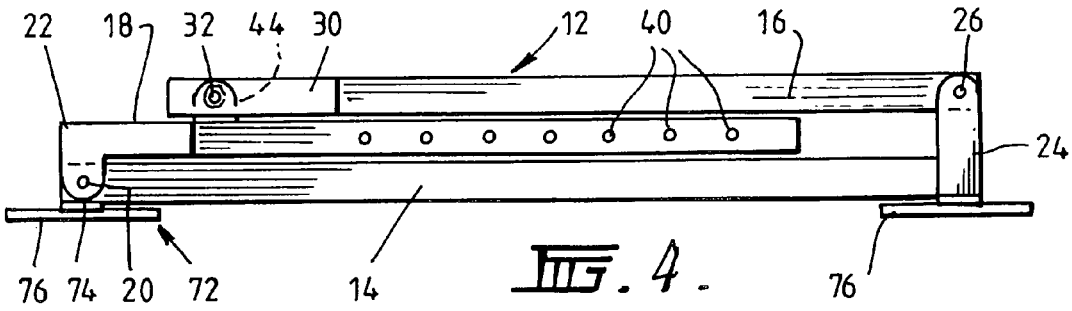
FIG. 4 is a similar view to that of FIG. 3 showing the roof scaffold bracket in the collapsed position.

In use, roof scaffold brackets 12 will be delivered on site in the collapsed condition shown in FIG. 4. The workmen will remove a roof screw (not shown) from the corrugated iron roof 42 at a desired location. A substitute screw 79 will be re-inserted into at least one hole 78 of at least one tab 74 and the screw fastened to secure a roof scaffold bracket 12 to roof 42 through engagement with a batten 81 or rafter. Tubes 76 will lie in the valleys of the corrugated iron roof 42 to prevent any lateral movement of bracket 12. Once bracket 12 is secured to the roof then platform support arm 16 and adjustment arm 18 can be unfolded through their pivotal attachment to roof fixing arm 14. Adjustment arm 18 is located between extensions 30 of platform support arm 16 and both arms are adjusted until platform support arm 16 is substantially horizontally disposed. Bolt 34 is then inserted in the aligned holes 32,40 to lock platform support arm 16 into the horizontal position. Similarly, a further roof scaffold bracket is secured parallel to and aligned with the just secured roof scaffold bracket. Handrail support arms 48 can then be attached to adjustment arms 18 by sliding sleeves 54 over the ends of adjustment arms 18 and securing them by bolts 58. Safety rails 62 are then clamped to handrail support arms 48 using U-clamps 60. If required, further support bracket 64 can also be secured to handrail support arms 48. Planks 36 and kickboard 38 can then be installed together with planks 70 to complete the assembly.

The invention according to this preferred embodiment will provide a very stable and safe operating environment for workmen on the roof. The roof scaffold support 10 does not damage the roof and allows workmen to walk on horizontal planks 36 rather than to try to balance at various angular dispositions on the roof itself. Coatings on the roof themselves are not damaged by the footwear of the workmen and there should be less damage from tools. The disassembly of the roof scaffold support 10 is the reverse procedure for its assembly. The original roofing screws can be replaced to complete the job. The safety rails 62 provide additional security for workmen as many industrial accidents occur from falling off rooves.

Figure 5:
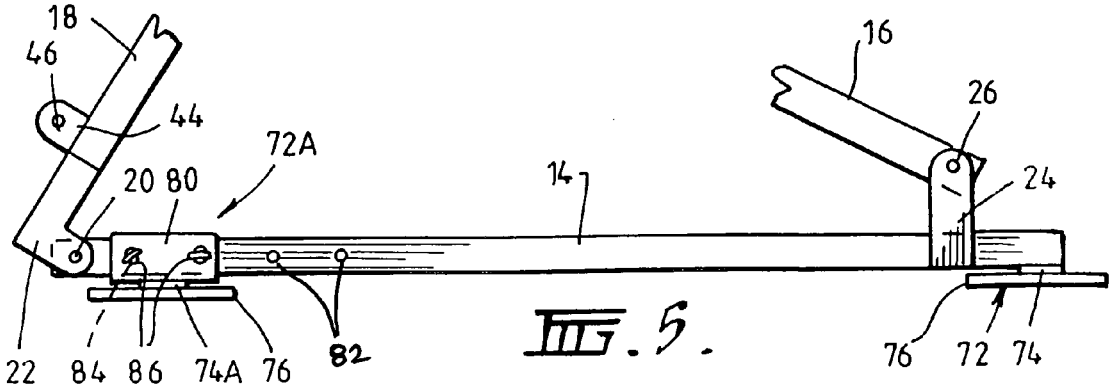
FIG. 5 is a similar view to that of FIG. 3 showing a variation to allow variation of the positioning of the foot for the roof scaffold bracket.
Figure 6:
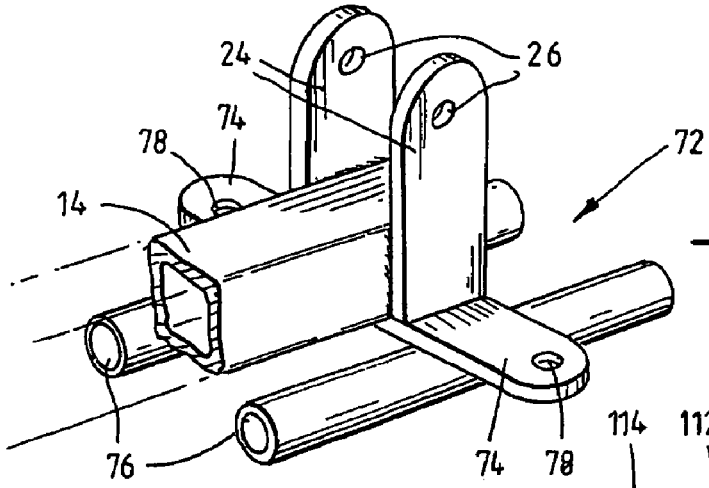
FIG. 6 is a perspective view of the foot of the roof scaffold bracket shown in FIG. 1.

FIG. 5 shows a variation of the roof scaffold bracket 12 shown in FIGS. 1 to 4 by having one of feet 72A being adjustably positioned. Tab 74A is welded to a sleeve 80 which is slidably located on roof fixing arm 14. Adjustment holes 82 can be aligned with holes 84 on sleeve 80 to allow the position of foot 72A to varied along the length of roof fixing arm 14 and locked by bolts 86. Another practical embodiment (not shown) has roof fixing arm 14 telescopic to vary its length. Such adjustments allow attachment of both feet of the roof scaffold bracket to be secured to the battens or rafters of the roof. These variations can be applied to any of the illustrated embodiments.

Figure 7:
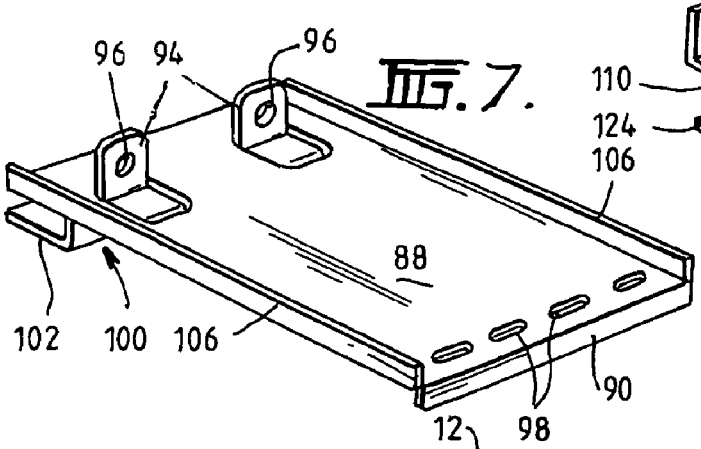
FIG. 7 is a first foot support plate for allowing the roof scaffold bracket of FIG. 1 to be used on a tiled roof.
Figure 9:
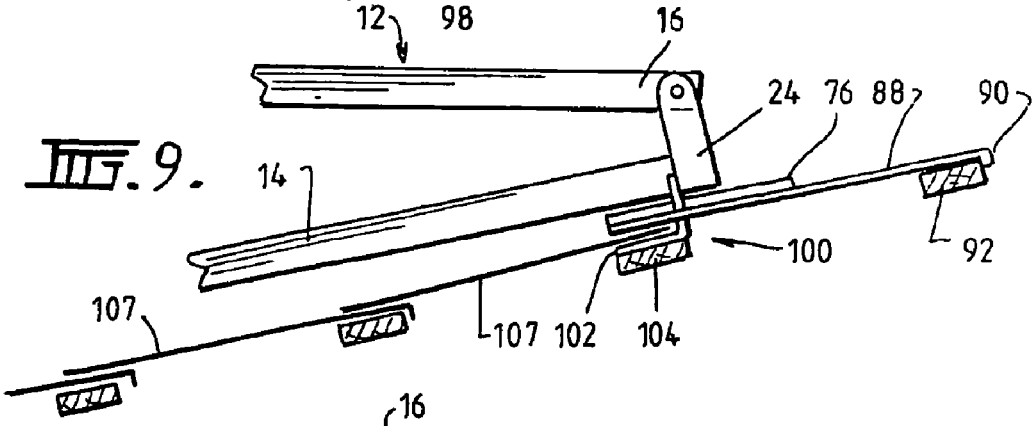
FIG. 9 is a side view of the roof scaffold bracket of FIG. 1 in combination with the first foot support plate shown in FIG. 7.

The embodiment shown in FIGS. 7 and 9 allows the roof scaffold bracket 12 of FIGS. 1 to 6 to be used on tile rooves. A foot support plate 88 is substituted for a tile on the roof. Plate 88 is basically rectangular in shape and is slightly larger than a roof tile. An end flange 90 is folded over at one end for abutment with a batten 92. A pair of tabs 94 are expressed from plate 88 and have holes 96 whose distance apart corresponds to the distance between tubes 76. Tubes 76 will, in use, be located in holes 96. Slots or holes 98 are for reception of screws (not shown) to allow foot support plate 88 to be secured to batten 92. An L-shaped bracket 100 is welded to the bottom of plate 88 and forms a foot 102 which, in use, rests on batten 104. A pair of lips 106 will ensure that rainwater does not seep into the roof space.

In use, tiles can be readily lifted and plate 88 substituted therefor to allow roof scaffold bracket 12 to be fitted. Plate 88 can be fastened to batten 92 through slots or holes 98. The top edge of tile 107 can be fitted into L-shaped bracket 100 to rest on foot 102. Tubes 76 of roof scaffold bracket 12 can slide into holes 96 of tabs 94 to allow tabs 24 to abut thereagainst. When work has been completed, plate 88 can be removed and replaced by a tile.

In FIGS. 8 and 10 a further type of support foot 108 is shown which cooperates with the roof scaffold bracket 12 shown in FIGS. 1 to 6. An L-shaped bracket 109 has a base part 110 and a vertical part 112. Vertical part 112 has holes 114 which receive tubes 76 of roof scaffold bracket 12. A support rod 116 is welded to the underneath of base part 110 and at the other end to a further L-shaped bracket 118. Bracket 118 has a vertical part 120 which is oriented at right angles to vertical part 112 of bracket 109 and a horizontal part 122. A protection strip 124 is slidably located on support rod 116 and provides a waterproofing for tiles.

In use, horizontal part 122 rests on a rafter 126 at the edge of the building and vertical part 120 abuts the side of rafter 126 and is secured thereto by a threaded fastener (not shown). Protection strip 124 will rest on a lower tile 128 and an upper tile 130 will rest on protection strip 124. Tubes 76 of roof scaffold bracket 12 will be inserted into holes 114. Tabs 24 of roof scaffold bracket 12 will abut vertical part 112 of bracket 109. This arrangement will allow roof scaffold bracket 12 to be used on the edge of a tiled roof, or on the framework of roof where tiles have not been installed.

In the embodiment of FIG. 11 a second variation of a roof scaffold bracket 132 is shown. This embodiment allows a more compact assembly as tabs 22 and 24 have been removed. Each of arms 14,16 are formed of U-shaped channel sections whilst arm is of hollow square section. The width of adjustment arm 18 is such that it will fit within the channel of roof fixing arm 14 and is pivotally coupled thereto by bolt 134. Platform support arm 16 is pivotally attached to roof fixing arm 14 by bolt 136. Platform support arm 16 is wider in cross-section than roof fixing arm 14 and can overlay both roof fixing arm 14 and adjustment arm 18 in the collapsed position.

Platform support arm 16 does not require extensions 30 as these have been replaced by slot 138 through which adjustment arm 18 can protrude. Handrail support arm 48 can be fitted in the same manner as roof scaffold bracket 12. Roof scaffold bracket 132 operates in a similar manner to roof scaffold bracket 12 and can use the foot support plates 88 and 108 of FIGS. 7 and 8 respectively. The major advantage of roof scaffold bracket 132 is the compact nature when not in use. As adjustment arm 18 folds into roof fixing arm 14 and thereafter platform support arm 16 folds over roof fixing arm 14 the roof scaffold bracket 132 will occupy a minimum amount of space for storage.

The invention provides a simple solution to providing worker safety on a pitched roof and will prevent industrial accidents due to falling. The system is compact and quick and easy to erect and dismantle. The invention can be used on any roof whether it has no roofing material installed or whether it is has corrugated iron or tiles installed. There is also no damage done to an existing roof whilst the roof scaffold support is erected.

The invention is not restricted to the preferred embodiments illustrated as many variations to the construction of the invention may be made. The preferred embodiments show practical examples of systems that work well.

The invention will be understood to embrace many further modifications as will be readily apparent to persons skilled in the art and which will be deemed to reside within the broad scope and ambit of the invention, there having been set forth herein only the broad nature of the invention and a certain specific embodiment by way of example.

The claims defining the invention are as follows:

1. A system in combination comprising:

a corrugated roof defining a slope angle and comprising at least one pair of longitudinally-extending valleys spaced in a parallel relation and extending at an angle substantially equal to the slope angle;

one or more roof scaffold brackets, each roof scaffold bracket comprising:

a first arm;

two support assemblies disposed at or near the respective end portions of the first arm for supporting the first arm relative to the roof, each assembly comprising:

two spaced, parallel longitudinally-extending members lying in the respective valleys of the corrugated roof, wherein the members extend at an angle substantially equal to the slope angle of the corrugated roof, and wherein the lying positions of the members in the respective valleys of the corrugated roof substantially prevent relative movement between the roof scaffold bracket and the corrugated roof in a direction transverse to the longitudinal axes of the members; and means for attaching the members to the first arm;

a second arm pivotally attached to the first arm; and a third arm attached to the first arm and to the second arm; and one or more planks at least partially supported by the respective second arms of the one or more roof scaffold brackets.

2. The system of claim 1 further comprising means for attaching the second arm to the third arm at one of several areas along the length of the third arm so that the angle that the second arm makes with the first arm can be varied accordingly.

3. The system of claim 2 wherein the variation in the angle of the second arm also varies the angle of the one or more planks.

4. The system of claim 1 wherein the second arm is attached to an end portion of the first arm.

5. The system of claim 1 wherein the an end portion of the second arm is attached to the first arm.

6. The system of claim 1 wherein the third arm is pivotally attached to the first arm.

7. The system of claim 1 wherein an end portion of the third arm is attached to an end portion of the first arm.

8. The system of claim 1 wherein an end portion of the second arm is attached to one end portion of the first arm and wherein an end portion of the third arm is attached to the other end portion of the first arm.

9. The system of claim 1 wherein the means for attaching the members to the first arm comprises a first bracket connecting one of the members to the first arm and a second bracket connecting the other member to the first arm.

10. The system of claim 1, further comprising a handrail connected to one of the arms.

* * * * *